United States Patent [19]

Landsberger

[11] 4,389,777

[45] Jun. 28, 1983

[54] EATING UTENSIL FOR USE BY THE MANUALLY IMPAIRED

[76] Inventor: David Landsberger, 60 Hibernia Rd., Rockaway, Morris County, N.J. 07866

[21] Appl. No.: 279,715

[22] Filed: Jul. 2, 1981

[51] Int. Cl.[3] ..... A47G 21/04

[52] U.S. Cl. ..... 30/324; 30/340

[58] Field of Search ..... 30/324, 325, 326, 327, 30/328, 342, 329, 340

[56] References Cited

U.S. PATENT DOCUMENTS

| | | | |
|---|---|---|---|
| 1,997,131 | 4/1935 | Champlin | 30/342 |
| 2,636,266 | 4/1953 | Sweet | 30/324 |
| 3,266,081 | 8/1966 | Heim | 30/340 X |
| 4,028,803 | 6/1977 | Currie | 30/324 X |
| 4,106,197 | 8/1978 | Russell | 30/324 |
| 4,355,465 | 10/1982 | Besson | 30/342 X |

*Primary Examiner*—Jimmy C. Peters

*Attorney, Agent, or Firm*—Anthony F. Cuoco

[57] ABSTRACT

An eating utensil for use by the manually impaired is disclosed. An easily grasped utensil handle is provided which may be weighted to enhance the use of the utensil. The handle may carry adjustably positioned rings for supporting the fingers of the user and may be built-up by having a sleeve disposed thereon to further facilitate grasping as may be required. The utensil may be attached to the user or to adjacent structure to prevent it from falling out of reach.

7 Claims, 4 Drawing Figures

EATING UTENSIL FOR USE BY THE MANUALLY IMPAIRED

BACKGROUND OF THE INVENTION

Those with poor hand muscle and/or motor control caused by, for example, arthritic conditions, post-operative conditions or general physical weakness have difficulty in grasping conventional eating utensils. While attempts have been made to construct such utensils to accommodate users suffering from these impairments, these attempts have not heretofore been entirely satisfactory. For example, utensils with leather or plastic grips have been provided, but provisions have not been made for supporting the individual fingers of the user as is often necessary. The desirability of weighting the utensil to facilitate its use to accommodate a particular impairment has not been addressed, nor has the utensil been arranged to prevent it from dropping out of reach of the user. The present invention accommodates the aforenoted and other requirements of the manually impaired as will be understood from the description of the invention to follow. These features combined with easy disassembly for cleaning and general lightness in weight enchance the characteristics of the invention for the use intended.

SUMMARY OF THE INVENTION

This invention contemplates an eating utensil for use by the manually impaired including a handle having a hollow base and a hollow cover therefor. A functional member such as a spoon or fork has a stem secured in the base and extends external therefrom. The base carries an external tab having a hole therethrough for receiving a cord or a strap or the like which may be attached to the wrist of the user, or attached to an adjacent table or tray or like structure, to prevent the utensil from dropping out of the user's reach. The handle cover is removably secured to the handle base by a pair of oppositely disposed end caps.

While the embodiment of the invention described as aforenoted may be suitable for some users, other embodiments of the invention are required for other users. Thus, in another embodiment of the invention a plurality of rings are adjustably disposed along the axis of the handle for supporting the fingers of a user who requires such support. In still another embodiment of the invention the handle is built-up by a sleeve which slips over the handle and thereby facilitates grasping of the utensil as may be required by other users.

DETAILED DESCRIPTION OF THE INVENTION

Figure 1:
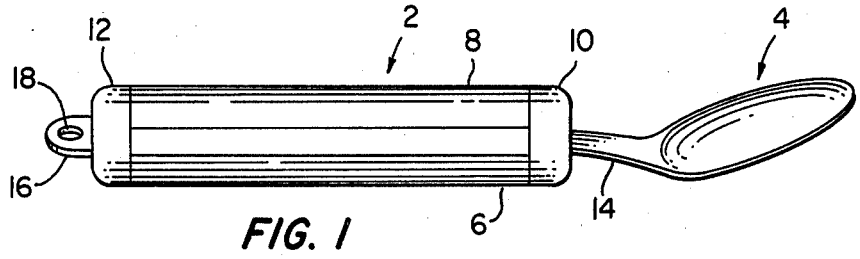
FIG. 1 is a pictorial representation showing the basic embodiment of the utensil of the invention including a handle and a functional member such as a spoon extending therefrom.

The basic embodiment of the invention as shown in FIG. 1 includes a handle designated generally by the numeral 2 and a functional member, shown for purposes of illustration as a spoon, designated generally by the numeral 4. Handle 2 is substantially hollow and cylindrical, and includes a base 6 and a removable cover 8 therefor. Cover 8 and base 6 are held together by a pair of oppositely disposed removable end caps 10 and 12. Handle 2 is sized to facilitate the grasping of the utensil by a user suffering from the aforementioned impairments.

Spoon 4 has a stem 14 supported in handle base 6 and extending externally therefrom at one end as will hereinafter be described with reference to FIG. 2. Base 6 has a tab 16 extending external therefrom at the opposite end. Tab 16 has a hole 18 therethrough which may carry a strap or a cord or the like (not shown) for securing the utensil of the invention to the wrist of the user, or to an adjacent structure such as a table, a chair or a tray to prevent the utensil from dropping out of the user's reach as will now be understood by those skilled in the art.

Figure 2:
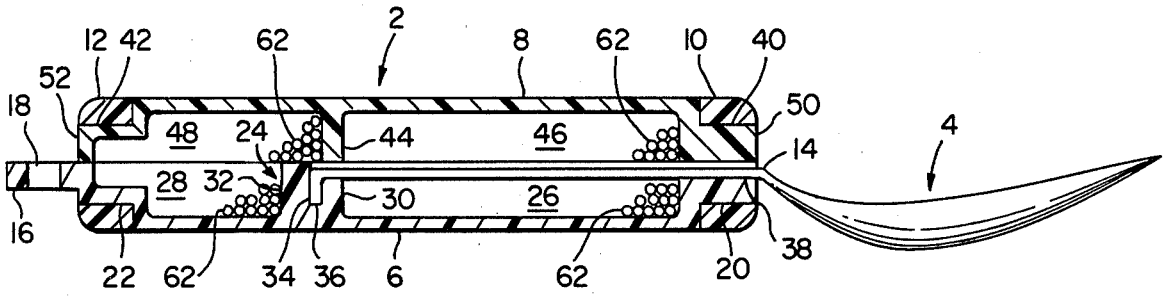
FIG. 2 is a sectional view of the embodiment of the invention shown in FIG. 1.

With reference now to FIG. 2, handle base 6 is a substantially hollow half cylinder terminating in a pair of end members 20 and 22 having equal radii substantially smaller than the radius of the main portion of the base between said end members.

A transversely extending wall 24 divides the interior of base 6 into a pair of chambers 26 and 28. Wall 24 has a side 30 adjacent chamber 26 which is substantially shorter than a side 32 adjacent chamber 28. Walls 30 and 32 are separated by a transversely extending slot 34.

Spoon stem 14 extends axially within handle base 6 terminating in an end member 36 which is substantially normal to the extending portion of stem 14. Member 36 fits snugly within slot 34 so that stem 14 is retained within the slot. Stem 14 is carried in the upper portion of chamber 26, resting in a semi-circular groove 38 carried by end member 20 prior to extending external from handle 6 as shown in the Figure.

Handle cover 8 is substantially hollow and otherwise identical in shape to handle base 6 so that when the cover is removably disposed over the base a complete cylinder is formed. To this extent handle cover 8 includes a pair of end members 40 and 42 corresponding to end members 20 and 22, respectively, of base 6. A wall 44 divides the interior of handle cover 8 into chambers 46 and 48.

With cover 8 disposed on top of base 6 subsequent to spoon stem 14 being disposed in groove 38 as aforenoted, end caps 10 and 12 are slipped over cylindrical end portions 50 and 52 of handle 2 formed by base end portion 20 and cover end portion 40, and base end portion 22 and cover end portion 42, respectively. The end caps fit snugly over and snap on the end portions so as to removably hold the cover and base together as will now be understood by those skilled in the art.

Figure 3:
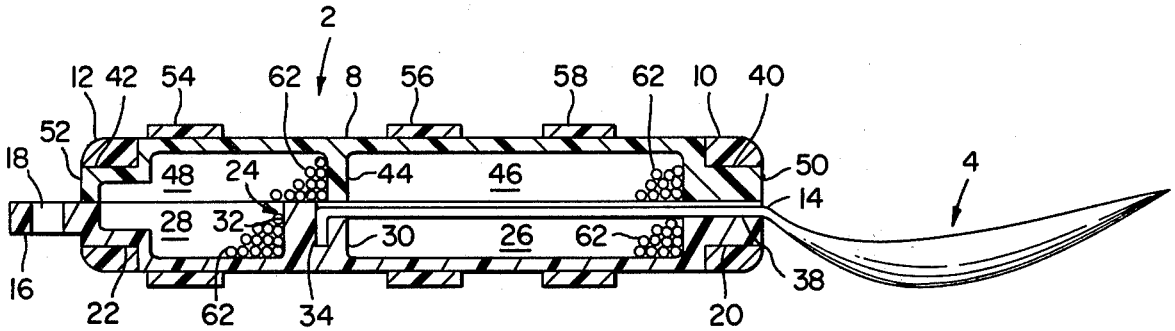
FIG. 3 is a sectional view of another embodiment of the invention, wherein a plurality of rings are adjustably disposed along the utensil handle for supporting the fingers of a user.
Figure 4:
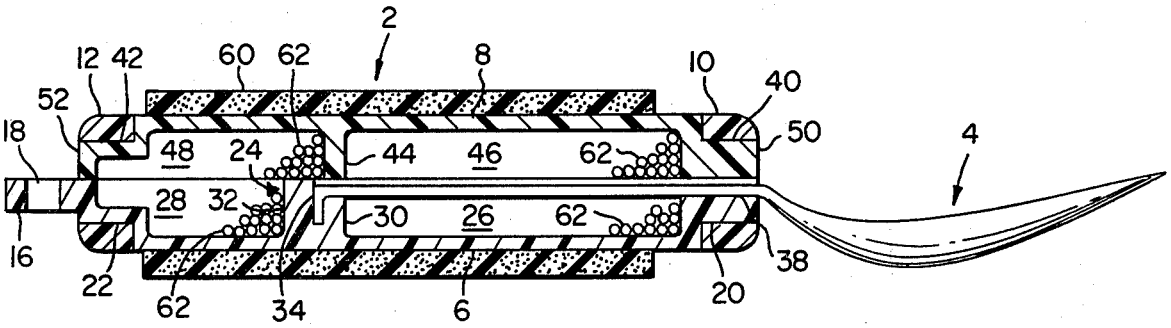
FIG. 4 is a sectional view of still another embodiment of the invention wherein a sleeve is disposed on the handle for building up the handle to assist the user in grasping the utensil.

With the basic embodiment of the invention shown in specific detail in FIGS. 1 and 2, other embodiments of the invention are shown in FIGS. 3 and 4, wherein corresponding numerals indicate corresponding elements.

With reference first to FIG. 3, a plurality of rings shown as three in number and designated by the numerals 54, 56 and 58 are arranged to slip over handle member 2, and while fitting snugly over the handle the rings are easily slideable along the axis thereof so as to be adjustably positioned on the handle.

It will be understood that a manual impairment of certain users requires finger support when grasping an eating utensil. The purpose of adjustably positioned rings 54, 56 and 58 is to provide said support and to thereby enhance the utility of the invention for those users so impaired.

With reference now to FIG. 4 wherein another embodiment of the invention is shown, it will be understood that there are certain users of the invention whose manual impairment is such that there are limitations on their hand closing or grasping capacity. For these users a built-up handle is required. This is accomplished by sliding a sleeve 60 over cylindrical handle 2 and to thereby permit grasping of the utensil with a more open grasp than would otherwise be the case.

The eating utensil described may be constructed of a light weight plastic material such as polypropylene. Rings 54, 56 and 58 and sleeve 60 may be a like material. Alternatively, sleeve 60 may be of a sponge rubber to accommodate users whose fingers may be sensitive, and to serve the further purpose of providing a non-slip grip to the handle as may be desirable. These features provide a relatively light weight utensil which is desirable for the purposes intended.

It will be understood that some users have impairments whereby their ability to effectively use the utensil is enhanced when the utensil is weighted. These users, while suffering poor manual motor control, have sufficient muscular strength in their hands so that lifting of the utensil when it is weighted is actually more effective than if the utensil were light in weight. To accommodate these users, chambers 26 and 28 in handle base 6, and chambers 46 and 48 in handle cover 8 may contain weights such as slugs or the like designated by the numeral 62 in FIGS. 2, 3, and 4. The weighting element may likewise be sand or pebbles or any other suitable substance for accomplishing the purposes intended. In this connection it is noted that the aforenoted weighting may be accomplished by at least one or more of the chambers carrying the weighting elements as the case may be.

There has thus been described an eating utensil for use by those with manual impairments resulting in poor manual muscle and/or motor control. A utensil is provided having a handle which may be attached to the user or adjacent structure to prevent the handle from falling out of reach. The utensil may be weighted to enhance its utility for users with certain impairments. For users with other impairments adjustable finger rings are provided for supporting the user's fingers, and for those with still other impairments the handle may be built-up so that the utensil may be used with a more open grasp than would otherwise be the case. Moreover, the construction of the invention as shown in FIGS. 1, 2 and 4 provides a utensil that may be easily disassembled for cleaning and reassembled for use so as to have further advantages for the use intended.

Having thus described the invention, what is claimed is:

1. An eating utensil for a manually impaired user, comprising:

a substantially hollow, cylindrical handle having a base section and a cover section which fits over the base section, and the handle being sized to facilitate grasping of the utensil by the user;

a functional member having an elongated stem;

means included within the base section for retaining the elongated stem so that said stem extends longitudinally along the axis of the base section;

a pair of end caps, each of which is in cooperative arrangement with an opposite end of the handle when the cover fits over the base section for removably retaining the cover and base section together; and the cover and base section arranged so that the stem of the functional member is captured within the hollow cylindrical handle when the cover and base section are removably retained together by the end caps, with the functional member thereupon extending along the axis of the handle and external thereto from an end thereof.

2. An eating utensil as described by claim 1, including;

a plurality of rings adjustably disposed along the axis of the handle for supporting the fingers of the user.

3. An eating utensil as described by claim 1, including:

a sleeve which fits over the handle for building up the handle to further facilitate the grasping of the utensil by the user.

4. An eating utensil as described by claims 2 and 3 wherein the means included within the base section for retaining the elongated stem so that said stem extends longitudinally along the axis of the base section includes:

a transversely extending wall within the base section;

a slot carried by the wall; and the elongated stem having an end extending substantially normal thereto which is received by the slot and retained therein.

5. An eating utensil as described by claim 4, including:

the transversely extending wall within the base section dividing said base section into first and second chambers;

another wall extending transversely within the cover section and dividing the cover section into third and fourth chambers; and weighting means carried in at least one of the first, second, third and fourth chambers for weighting the handle to facilitate use of the utensil by users with a particular manual impairment.

6. An eating utensil as described by claim 1, including:

a tab extending externally from the handle at the end thereof opposite the end from which the functional member extends;

a through hole carried by the tab; and means carried by the hole for retaining the utensil in close proximity to the user.

7. An eating utensil as described by claim 1, wherein:

the base section and the cover section which fits over the base section are each semi-cylindrical so that the handle is symmetrical about its axis;

the radii of the opposite ends of the cover and base sections are such that the diameter of the handle at said opposite ends is smaller than the diameter of the portion of the handle between the ends;

the end caps are substantially ring-shaped, with an inside diameter corresponding to that of the handle ends and an outside diameter corresponding to that of the portion between the ends; and the ring-shaped end caps fit snugly over the opposite handle hands for removably retaining the cover and base section together, with the handle thereupon being cylindrical and a single diameter from one end to the other.

* * * * *